US009733042B2

(12) United States Patent
Yuen et al.

(10) Patent No.: US 9,733,042 B2
(45) Date of Patent: Aug. 15, 2017

(54) PAINTBALL LOADER WITH HINGED SIDEWALL

(71) Applicant: GI SPORTZ DIRECT LLC, Sewell, NJ (US)

(72) Inventors: Sze Ming Yuen, Deptford, NJ (US); Louis Spicer, Sewell, NJ (US)

(73) Assignee: GI SPORTZ DIRECT LLC, Sewell, NJ (US)

( * ) Notice: Subject to any disclaimer, the term of this patent is extended or adjusted under 35 U.S.C. 154(b) by 0 days.

(21) Appl. No.: 15/094,595

(22) Filed: Apr. 8, 2016

(65) Prior Publication Data

US 2016/0298924 A1 Oct. 13, 2016

Related U.S. Application Data

(60) Provisional application No. 62/144,637, filed on Apr. 8, 2015.

(51) Int. Cl.
*F41B 11/00* (2013.01)
*F41B 11/53* (2013.01)

(52) U.S. Cl.
CPC ..... *F41B 11/53* (2013.01)

(58) Field of Classification Search
CPC ..... F41B 11/50; F41B 11/52; F41B 11/53
See application file for complete search history.

(56) References Cited

U.S. PATENT DOCUMENTS

| | | | | |
|---|---|---|---|---|
| 3,828,972 | A * | 8/1974 | Bender | A61J 7/04 221/197 |
| 5,655,553 | A * | 8/1997 | Giese | A45D 40/24 132/293 |
| 5,765,718 | A * | 6/1998 | Grasso | A47K 10/3818 221/1 |
| 5,782,379 | A * | 7/1998 | Traub | A45D 29/20 132/285 |
| 7,028,860 | B2 * | 4/2006 | Behnke | A47K 10/422 221/49 |
| 7,343,909 | B2 | 3/2008 | Christopher et al. | |
| 7,568,478 | B2 | 8/2009 | Hedberg | |
| 7,591,260 | B1 | 9/2009 | Mu | |
| 7,854,220 | B1 | 12/2010 | Neumaster | |
| 8,047,191 | B2 | 11/2011 | Christopher et al. | |
| 8,235,030 | B2 * | 8/2012 | Kaakkola | F41B 11/52 124/49 |
| 8,251,050 | B2 | 8/2012 | Christopher et al. | |
| 8,375,929 | B2 | 2/2013 | Andersen | |
| 8,387,607 | B2 | 3/2013 | Christopher et al. | |
| 8,448,631 | B2 | 5/2013 | Spicer et al. | |
| 8,561,600 | B2 | 10/2013 | Christopher et al. | |
| 8,746,225 | B2 | 6/2014 | Christopher et al. | |
| 2009/0173330 | A1 * | 7/2009 | Akins | F41B 11/52 124/45 |

* cited by examiner

*Primary Examiner* — John Ricci
(74) *Attorney, Agent, or Firm* — Volpe and Koenig, P.C.

(57) ABSTRACT

A paintball loader is provided having a body split vertically along a length of the body into two side portions, wherein the side portions are attached by a hinge along an upper portion of the paintball loader body.

6 Claims, 12 Drawing Sheets

PAINTBALL LOADER WITH HINGED SIDEWALL

CROSS REFERENCE TO RELATED APPLICATION

This application claims priority to U.S. Provisional Patent Application No. 62/144,637, filed Apr. 8, 2015, the entire contents of which are hereby incorporated by reference as if fully set forth herein

FIELD OF INVENTION

This invention relates to the field of paintball loaders, and more particularly, to a paintball loader having a hinged body for ease of access to internal components through a side of the paintball loader body.

BACKGROUND

Paintball loaders (otherwise known and used interchangeably herein as hoppers, magazines, projectile loaders, or loaders) generally sit atop the markers and feed projectiles into the marker. These projectile loaders store projectiles and have an outlet or exit tube (outfeed tube or neck). The outlet tube is connected to an inlet tube (or feed neck) of the paintball marker, which is in communication with the breech of the marker. During the normal operation, paintballs dropped through the outlet of the loader from a paintball stack within the outlet tube and gun inlet tube. When the paintball at the bottom of the stack is dropped into the firing chamber of the paintball marker, it is replaced at the top of the stack from the supply of paintballs remaining in the loader housing, thereby replenishing the stack. Thus, the loaders act to hold and feed paintball projectiles into the breech of a paintball marker, so that the projectiles can be fired from the marker.

Many loaders contain agitators or feed systems to mix, propel, or otherwise move projectiles in the loader. This mixing is performed by an impeller, projection, drive cone, agitator, paddle, arm, fin, carrier, or any other suitable mechanism, such as those shown and described in U.S. patent application Ser. No. 12/171,956 and U.S. Pat. Nos. 6,213,110; 6,502,567; 5,947,100; 5,791,325; 5,954,042; 6,109,252; 6,889,680; and 6,792,933; the entire contents of all of which are incorporated by reference herein. In "gravity feed" hoppers, a hopper has no moving parts, and paintballs fall into an outfeed tube by gravity. In "agitating" loaders, an agitator mixes projectiles so that no jams occur at the exit opening of the outlet tube. In "force feed" or "active feed" paintball loaders, the agitator or feeder (drive cone, carrier, paddle, or any other force feed drive system) forces projectiles through the exit tube. As the firing rates of paintball markers have increased, active feed loaders have become extremely popular due to their ability to ensure the proper feeding of projectiles and sustain the feed rates necessary to support today's markers.

Modern paintball loaders utilize projections, paddles, arms, carriers, drive cones, or other agitators to mix or advance paintballs. These agitators are operated by motors which are often controlled by an electronic control circuit. These control circuits may utilize microprocessors in conjunction with at least one sensor configured to detect any number of parameters, including the firing of a projectile from the marker or the occurrence of a jam. These components are typically powered by a D.C. power source, such as a battery.

It is often necessary for a paintball sport player to access the interior components of a paintball loader. However, because the agitators, control circuits, power supplies, sensors, and drive mechanisms are traditionally enclosed inside the body of the paintball loader, these components can typically only be reached by partially or fully disassembling the loader. This arrangement results in difficult and time consuming maintenance, repair, and upgrade procedures.

Moreover, if a paintball breaks inside a paintball loader, there must be a convenient and efficient way to open the body and clean the paint or dye from the inside of the paintball hopper, without having to fully disassemble the loader.

Virtually all of the known solutions to the issue of gaining easy access to the interior components of a paintball loader have focused on dividing the body along a horizontal axis, essentially having a removable top or upper portion, and a lower portion housing the internal components. This still has drawbacks, and requires some disassembly. In addition, many of the internal components are still not accessible when the upper portions are removed.

Thus, there is the need for a paintball loader and feed mechanism that provides quick and complete access to the feed system components in order to facilitate maintenance, cleaning, or upgrading.

SUMMARY OF THE INVENTION

The present invention provides for a paintball loader comprising a body with a first side and a second side, the body split along a generally vertical axis along the length of the body, and wherein both sides of the body are held together by a hinge. The sides of the body of the paintball loader can be moved away from each other via the hinge, providing a side-open access to the interior of the paintball loader.

DESCRIPTION OF THE INVENTION

Figure 1:
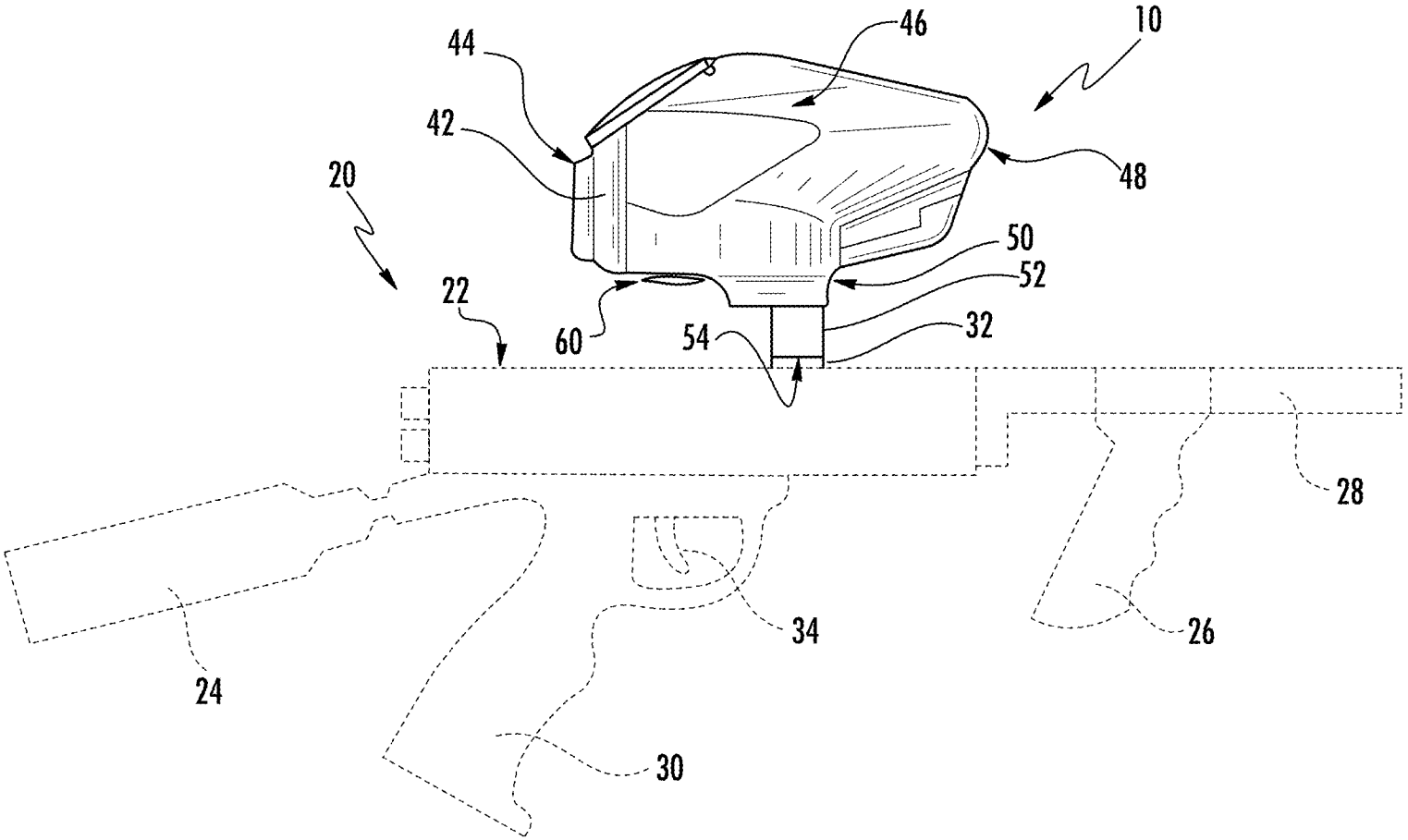
FIG. 1 is a side elevational view of an exemplary paintball loader attached to a paintball marker (gun) shown in phantom.

FIG. 1 is a side elevational view of a paintball loader 10 operatively attached to a representative paintball marker (gun) 20, illustrated in phantom. The paintball marker 20 includes a main body 22, a compressed gas cylinder 24, a front handgrip 26, a barrel 28, and a rear handgrip 30. The paintball marker 20 also includes an inlet tube 32 leading to a firing chamber in the interior of the main body and a trigger 34. The front handgrip 26 projects downwardly from the barrel 28 and provides an area for gripping by an operator of the paintball marker 20. The compressed gas cylinder 24 is typically secured to a rear portion of the paintball marker 20. The compressed gas cylinder 24 normally contains $CO_2$, although any compressible gas may be used.

A paintball loader 10, such as one which may be used for the present invention, includes a body 46 which houses an open interior area 844, a rear end 44, and a front end 48. The paintball loader 10 may include a portion having control circuitry or electronics 42, which may include a microprocessor, for controlling various operating parameters of the paintball loader. The lower portion 50 of the paintball loader leads to an outfeed, exit tube, or feed neck 52, which communicates with the infeed tube 32 to supply paintballs to the paintball marker 20. A manual drive assistance actuator 60 may be provided to turn the feeder inside the paintball loader body 46.

In operating the paintball marker 20, the trigger 34 is squeezed, thereby actuating the compressed gas cylinder 24 to release bursts of compressed gas. The bursts of gas are used to fire paintballs outwardly through the barrel 28. The paintballs are continually fed by the paintball loader 10 through the inlet tube 32 to the firing chamber.

Some paintball loaders or feeders are described in detail in U.S. Pat. No. 6,213,110 ("Rapid Feed Paintball Loader"), U.S. Pat. No. 6,502,567 ("Rapid Feed Paintball Loader With Pivotable Deflector"), U.S. Pat. No. 6,701,907 ("Spring Loaded Feed Mechanism For Paintball Loader"), and U.S. Pat. No. 6,792,933 ("Drive Cone For Paintball Loader"), the entire contents of which are each incorporated by reference herein.

Figure 2:
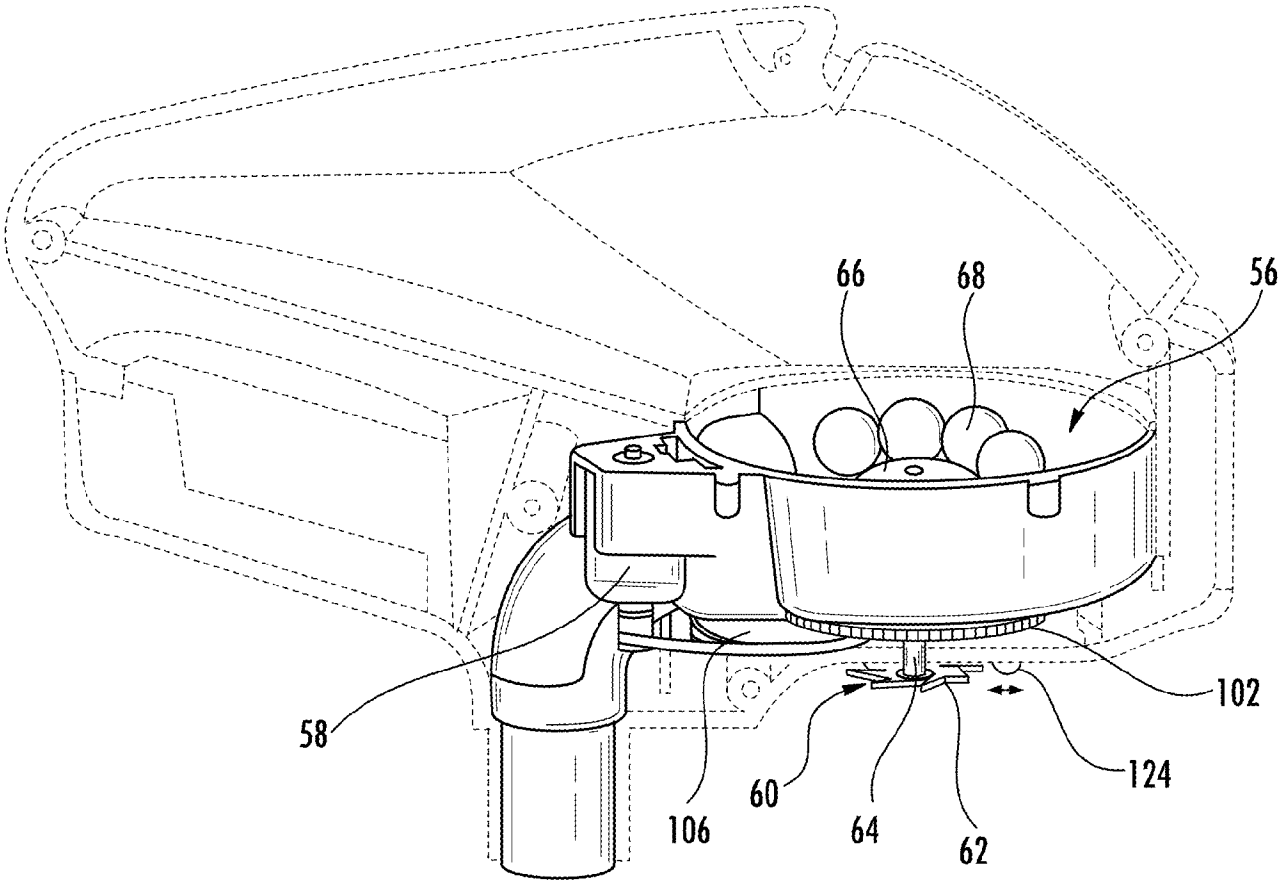
FIG. 2 is a side partial cutaway of a paintball loader, showing the internal feed mechanism, with a portion of the body shown in phantom.

As shown in FIG. 2, a feed mechanism 56 is generally used to drive, feed, move, or urge the paintballs toward the exit tube 52 and into the inlet tube 32 of the paintball marker 20. The feed mechanism 56 preferably includes a feeder 66 positioned within the paintball loader body and coupled to a drive shaft, with the drive shaft 64 coupled to a motor 58 and gear system 102, 106, to drive paintballs 68 toward the exit tube 52. While an illustrative feed mechanism 66 is shown, various other components may be substituted for driving paintballs into the paintball marker 20. A catch cup portion 70 may house the feeder 66, and act as a reservoir or well where the paintballs 68 are held for feeding.

A variety of feed mechanisms 56 and feeders 66 can be used in the present invention, including an impeller, drive cone, paddle wheel, fin, carrier, or other device which can direct or otherwise force or urge paintballs into the exit tube 52. By way of example and not limitation, a drive cone may be used with a plurality of fins which preferably extend in a radial direction from the central part of the drive cone. It is appreciated that the feeder may include recesses or pockets within which the paintballs sit as they are shuttled toward the exit tube 52. The feeder 66 may be mounted on a drive shaft 64. The drive shaft 64 is connected to the motor 58 to rotate about a central axis. As the motor 58 operates, the feeder 66 moves, pushing balls into exit tube 52.

While a feed mechanism is shown, it is appreciated that a paintball loader according to the present invention could be formed without an interior moving feed mechanism or feeder, and work as a gravity fed hopper.

As shown in FIGS. 3-7, a side opening paintball loader 900 according to the present invention includes a body 901 with an interior area 844, which houses internal components of the paintball loader 900, such as, by way of example, the feed mechanism, power supply, or source (e.g., batteries or battery pack), and/or circuitry. As used herein "side opening" means having one or more body portions that open by moving away from a vertical plane running along the length of the paintball loader body. Thus, the body portions open to the left side or right side when facing the paintball loader from the front or rear.

The body 901 includes at least a first portion 902 and a second portion 903. For example, looking directly at the paintball loader 900 from the front or nose portion 866, the first portion 902 may be all or part of a left side 899 of the body 901, and the second portion 903 may be all or part of a right side 904 of the body 901. The body 901 is essentially split vertically along a vertical plane running down the middle of the body 901, with an opening at the bottom 888. In this manner, the body 901 opens at the bottom to receive interior components of the paintball loader. Preferably, according to the present invention, the body 901 is split longitudinally along the length of the body 901, from the nose portion 866 to the back area 910. Preferably, no split in the body is provided transversely, such as across the width of the body 901. Preferably, no split in the body is provided along a horizontal plane, such as in a top/bottom split arrangement.

The first portion 902 and the second portion 903 are attached by a hinge 905. The hinge is preferably positioned along a division seam 906 between the first portion 902 and the second portion 903, positioned along the upper central portion 907 or spine 877 of the body 901. The hinge may be any type of hinge, including, for example, but not limited to, a mechanical hinge of any kind, a hinge such as on a door or cabinet, a butt hinge, living hinge, or strap hinge. One or more hinges may be provided. The hinge may be self-closing such as with a spring-biased hinge, or otherwise biased to a closed or open position. The first portion 902 and the second portion 903 move relative to each other, via the hinge 905. Thus, a moveable joint or mechanism is provided to allow movement of the first portion 902 and the second portion 903.

Figure 3:
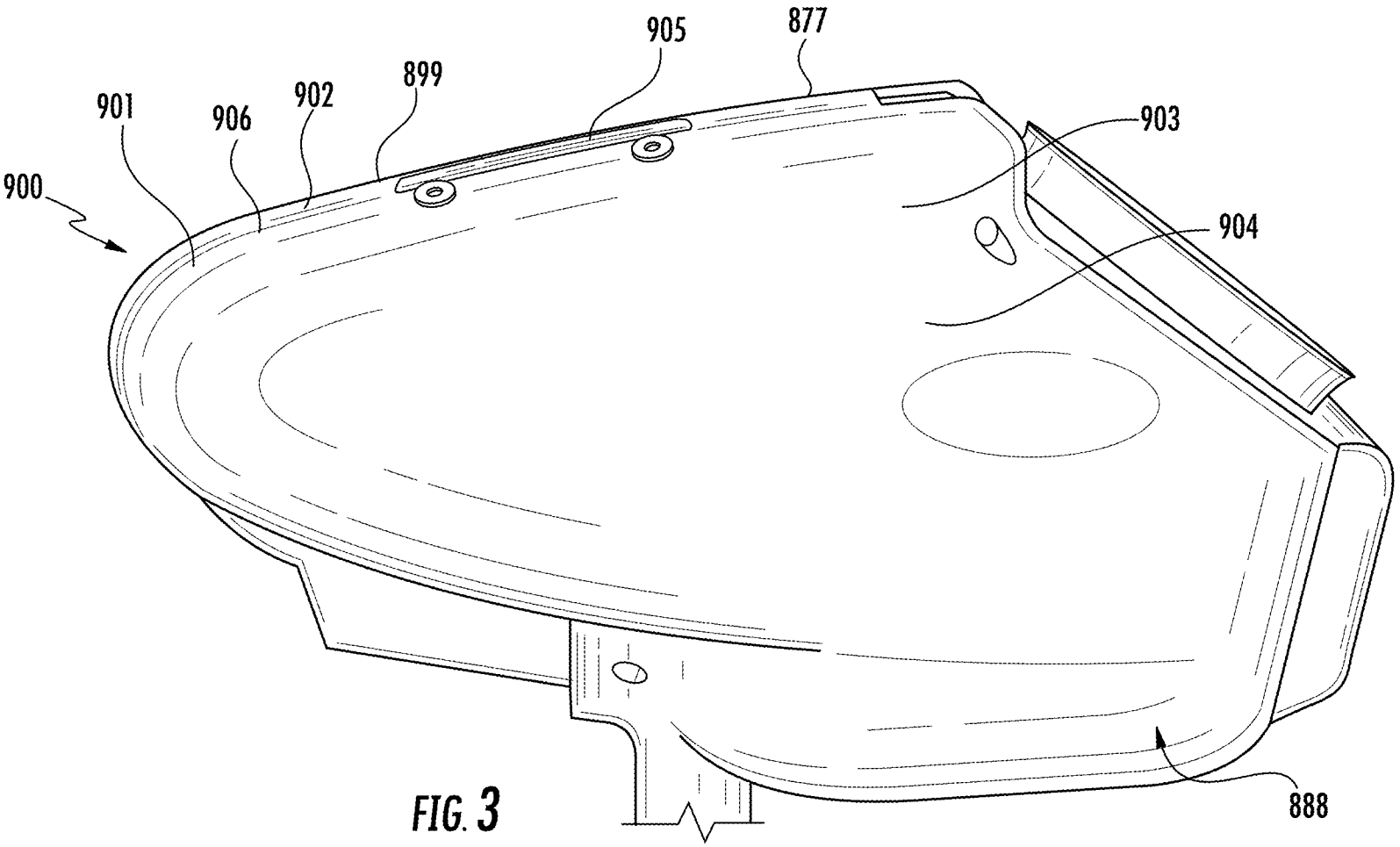
FIG. 3 is a side view of a paintball loader having a hinged body according to the present invention.
Figure 4:
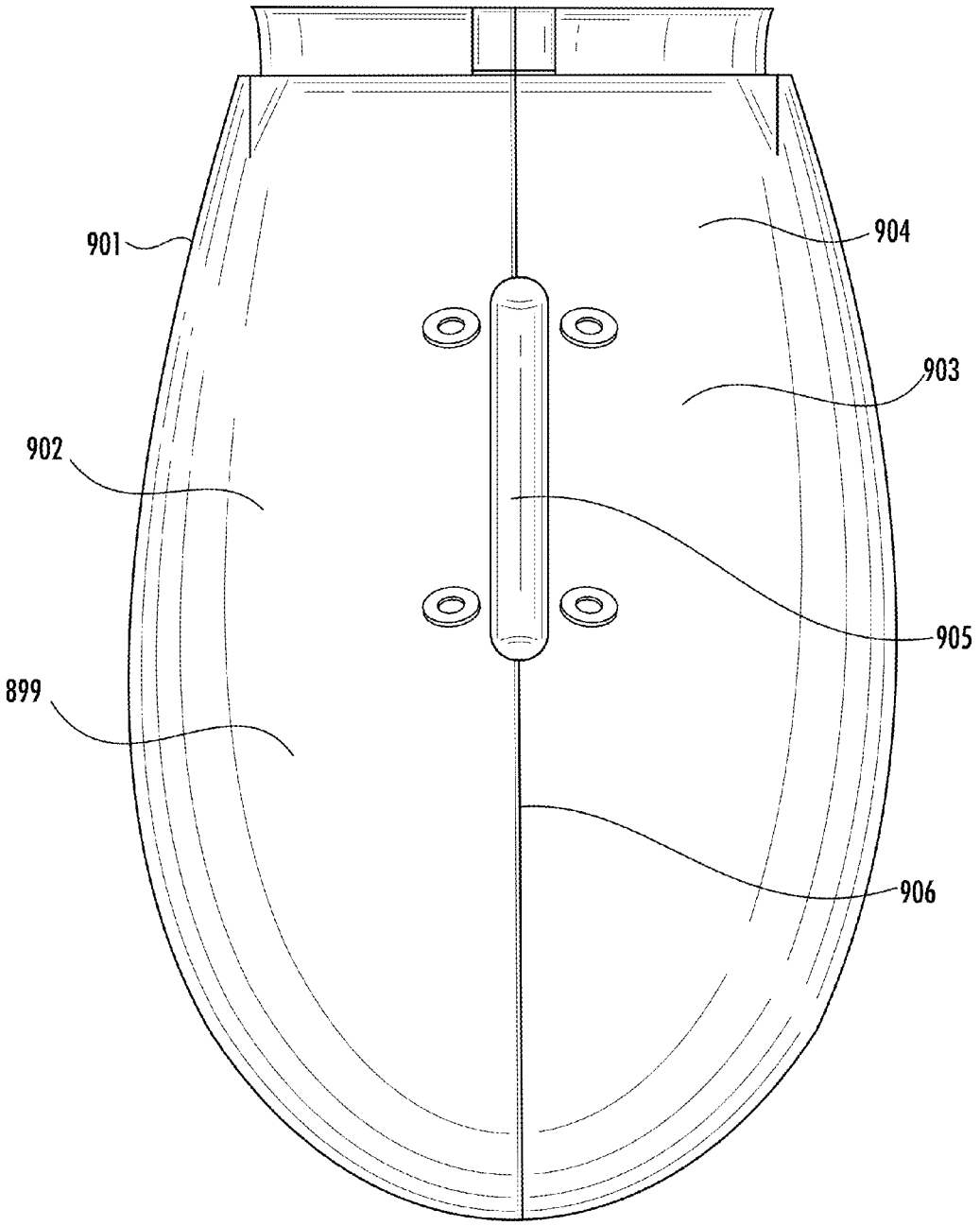
FIG. 4 is a view from the front of the paintball loader having a hinged body according to the present invention shown in FIG. 3.
Figure 5:
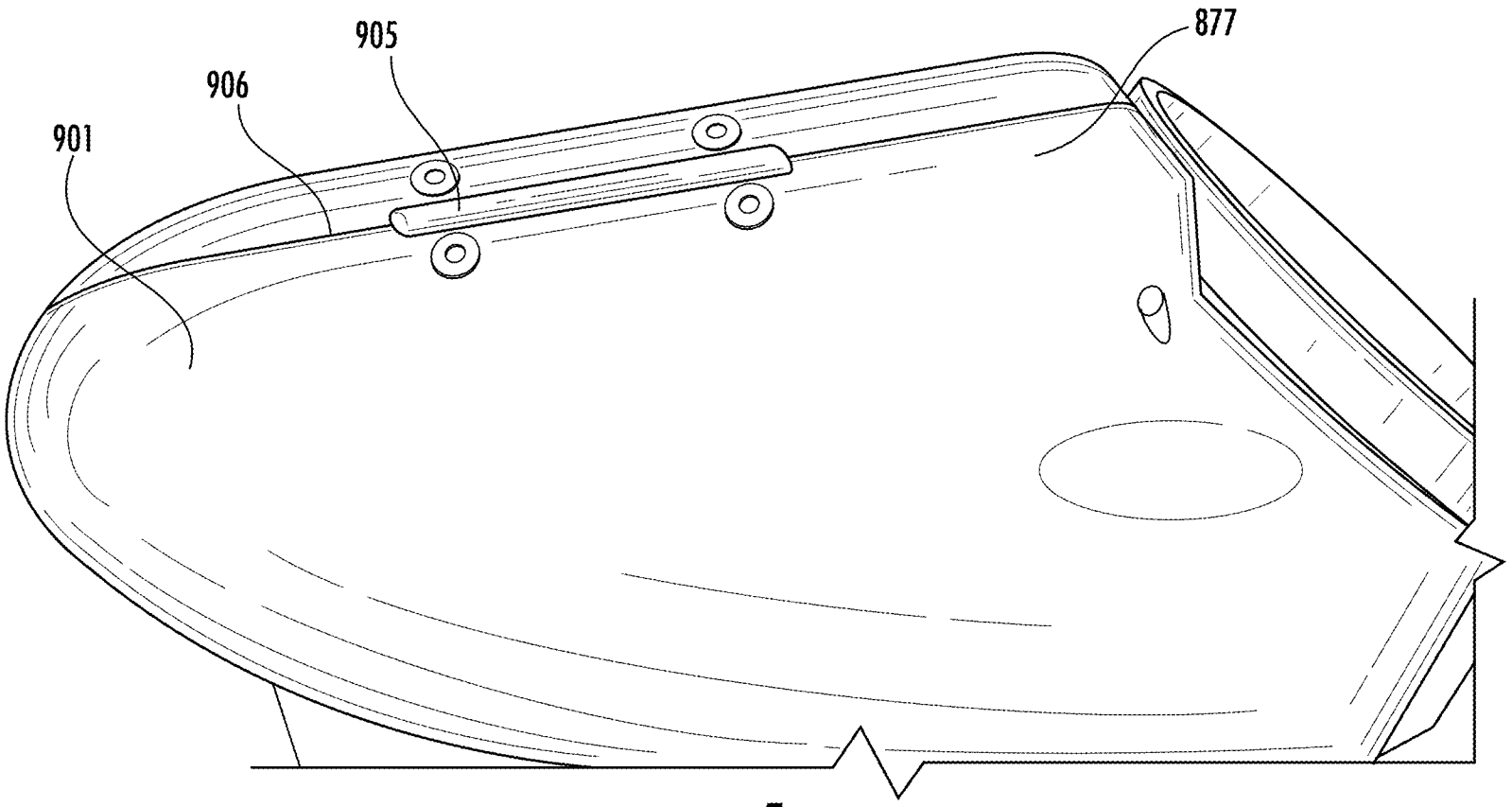
FIG. 5 is a side view of a paintball loader having a hinged body according to the present invention shown in FIG. 3, with the upper portion or wall and hinge shown in close-up.

FIGS. 3-7 depict a paintball loader body 901 according to the present invention in use with the internal components of a well-known paintball loader, offered under the EMPIRE® and HALO® brand names. The feed mechanism may be similar to that shown in FIG. 2. The body 901 comprises a first portion 902 and a second portion 903, attached by a hinge 905. The hinge 905 is located along the spine 877 along the upper top of the paintball loader body 901. As shown in FIG. 3, the first portion 902 and second portion 903 each comprise about half of the paintball loader body, although other relative portions can be used when dividing the body. For example, the first portion may be the majority of the paintball loader body, and the second portion may be a smaller panel that opens, or vice versa.

Each of the first portion 902 and second portion 903 include a front or nose portion 866, top wall 908, an opening or mouth area for receiving paintballs 909, a rear or back area 910, a lower wall rear 911, a feed neck portion 912, and a battery area 913, and a lower front wall 914. The first portion 902 and second portion 903 may be secured to each other via any selected engagement means, such as, by way of example and not by way of limitation, a friction fit, a snapping engagement, or any other latching mechanism. One portion of the body may have an extension snappingly received in an opening in the other portion of the body. The first portion 902 and second portion 903 may be held together with a removable pin such as a cotter-type pin or a spring biased pin that projects through holes formed in each the portions. The first portion 902 and second portion 903 may have releasable attachments at a plurality of locations along the meeting or facing edges of the body portions.

Figure 11:
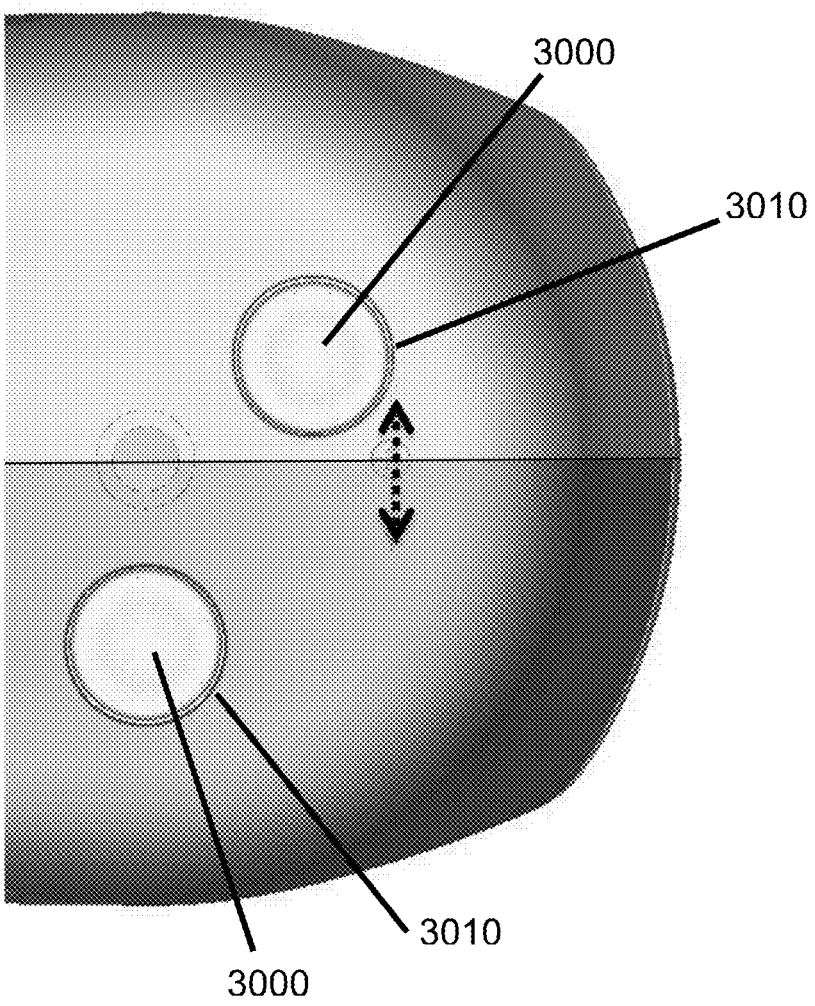
FIG. 11 shows a view of the bottom of a paintball loader according to the invention, adjacent the rear of the body, including an example of a release mechanism.

A button or other type of release may be positioned on a portion of the body to release the two body portions so that the body can be opened, and may operate as an attachment and release mechanism. As shown in FIG. 11, a bottom view adjacent a rear portion of the body, one or more depressible or flexible buttons 3000 formed on each body portion could extend through one or more openings 3010 in the body portions. Depressing the buttons 3000 would release the body portions so that they could be separated as shown by the arrows. The body portions would remain connected by the hinge at the top of the body.

Figure 6:
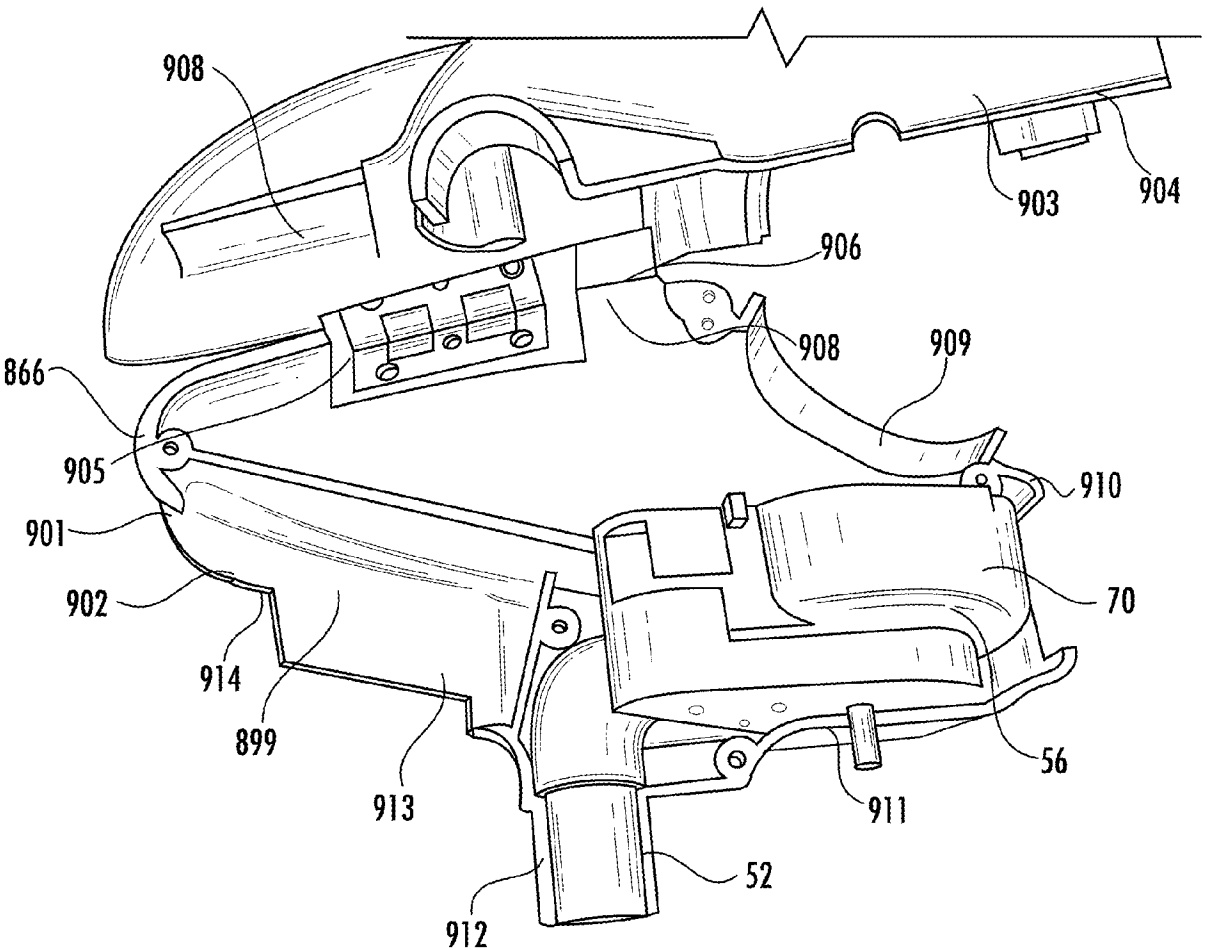
FIG. 6 is a side view of a paintball loader having a hinged body according to the present invention shown in FIG. 3, shown in an open position with the right side lifted to expose the feed mechanism.
Figure 7:
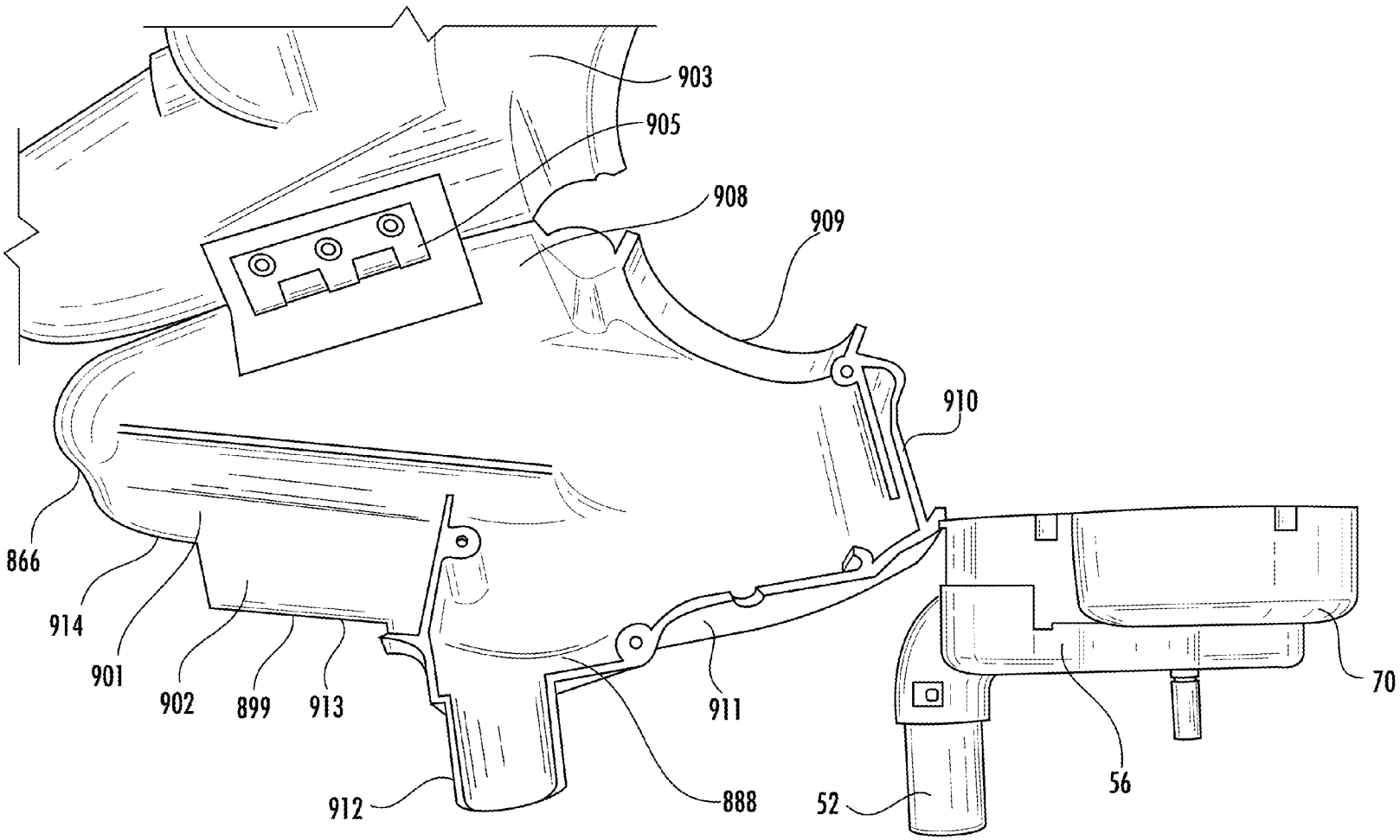
FIG. 7 is a side view of a paintball loader having a hinged body according to the present invention shown in FIG. 3, with the feed mechanism completely removed from the hinged body.

As shown in FIGS. 6 and 7, when at least one body portion is pivoted away from the other portion via the hinge to an "open" position, the interior components of the paintball loader are accessible. The body portions may move in an arc, moving about the hinge. For example, in FIG. 7, the entire feed mechanism assembly 56 is accessible, and may be totally removable, when the body is opened in the open position. Maintenance can be easily performed, and the body portions, although opened, still remain attached via the hinge, for ease of use, removal, and assembly. Different parts of the body are less likely to be lost if they remain attached via the hinge. If a paintball has "jammed" inside the feed mechanism 56, such a jam can be easily cleared. The paintball loader can then be readily assembled by placing the feed mechanism 56 within the body, and closing the body by bringing the portions into contact.

The feed mechanism 56 may comprise a drive shaft 64, a feeder 66, a motor 58 coupled to the drive shaft 64, and a power source such as a battery, or a combination of those components. The feed mechanism 56 may comprise a molded or integral catch cup 70 and exit tube 52 that can be readily removed as a complete unit when the body is in the open position.

Figure 8:
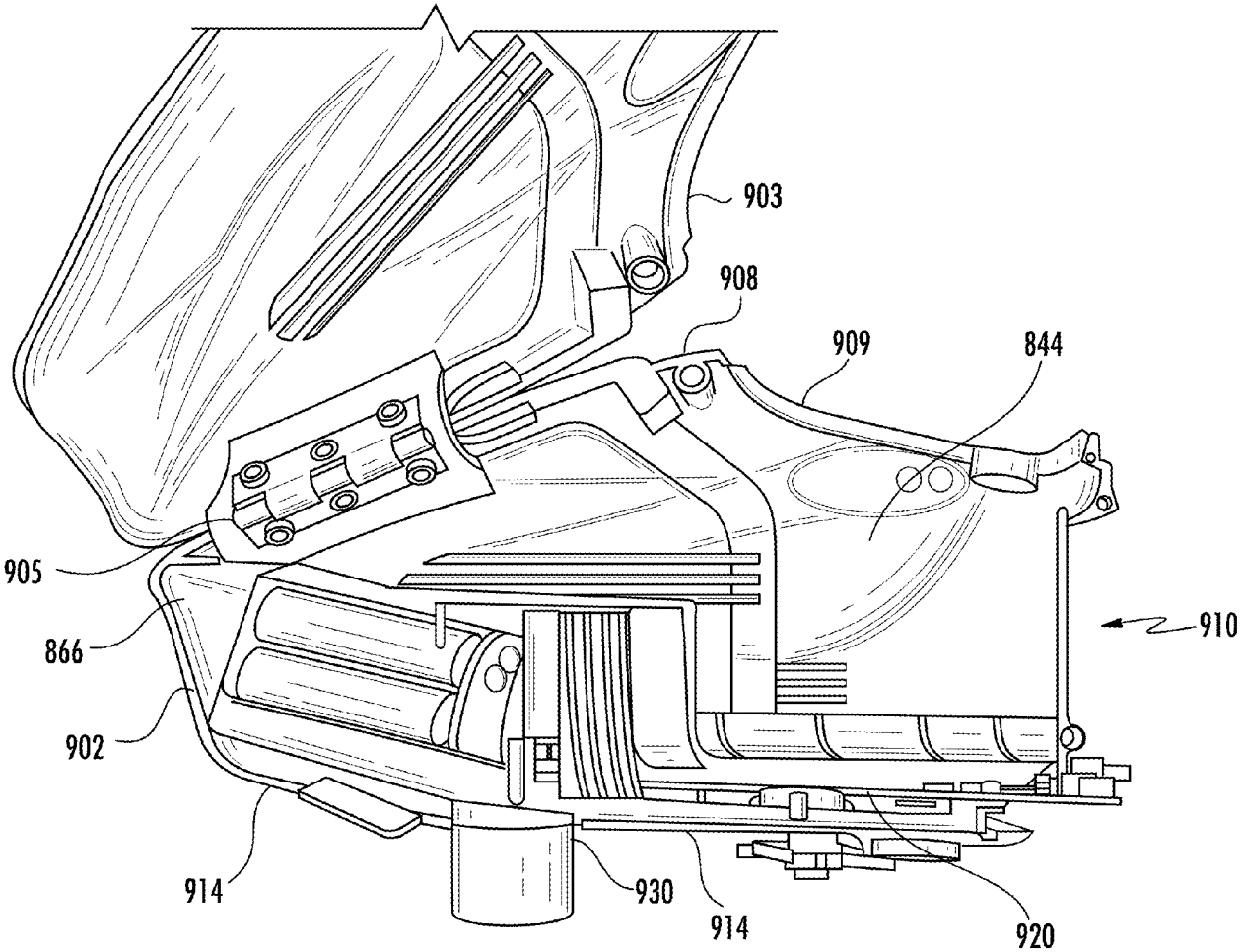
FIG. 8 is a side view of another embodiment of a paintball loader having a hinged body according to the present invention.
Figure 9:
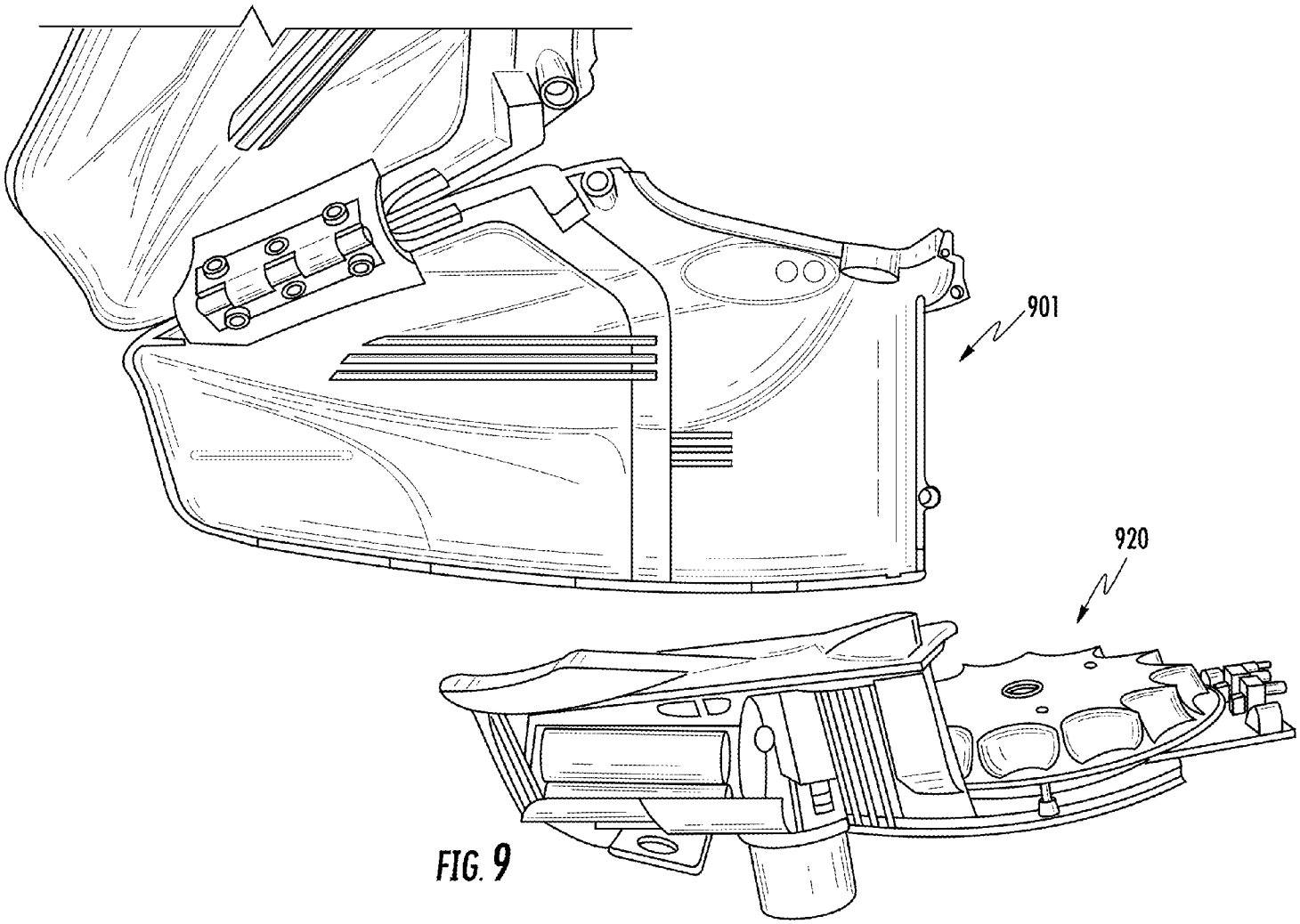
FIG. 9 is a side view of a paintball loader having a hinged body according to the present invention shown in FIG. 8, with the feed mechanism completely removed from the hinged body.
Figure 10:
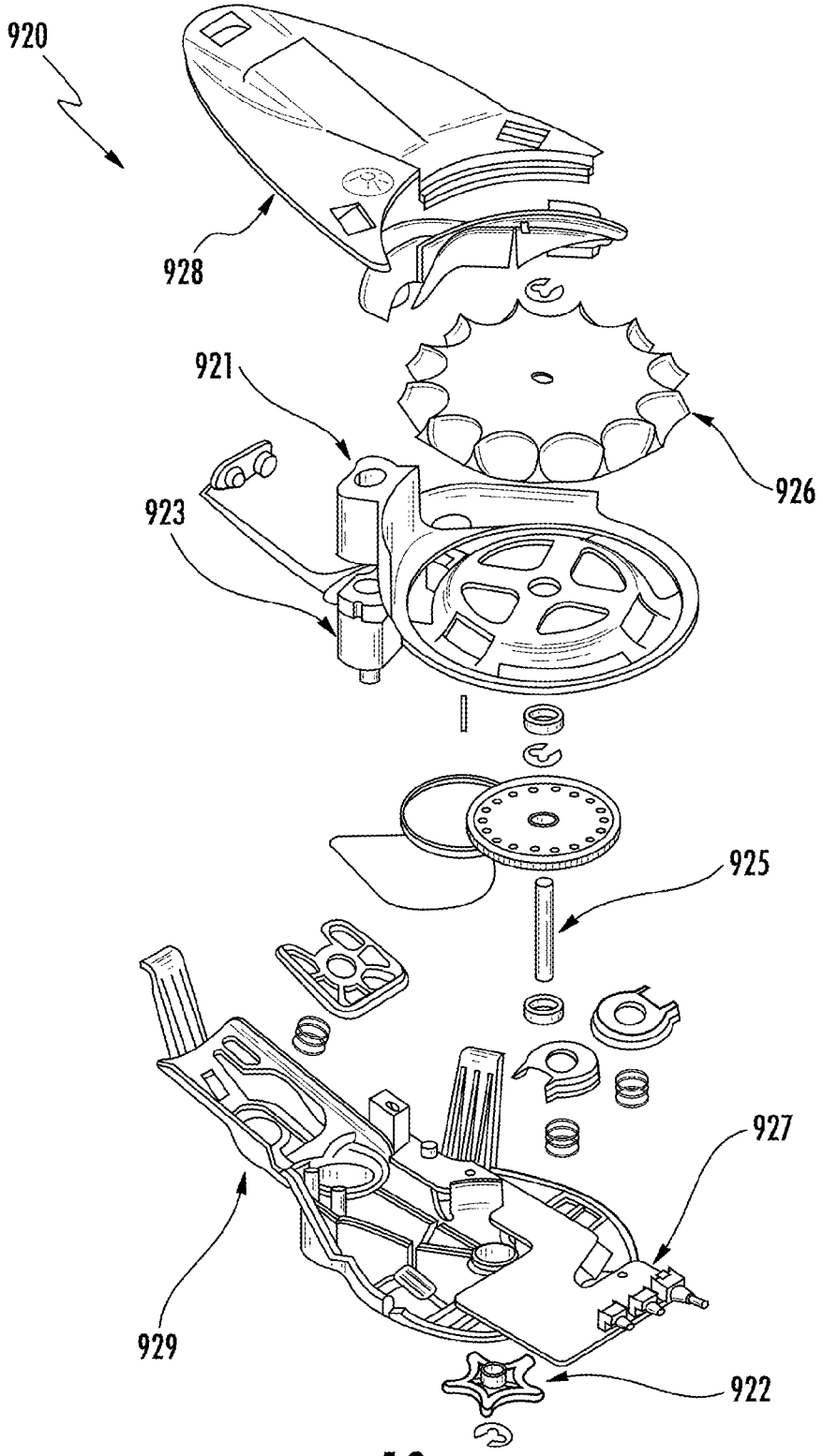
FIG. 10 is an exploded view of component parts of a feed mechanism for use with a hinged paintball loader body of the present invention.

Another embodiment of a paintball loader body according to the present invention is shown in FIGS. 8-10. This embodiment has components based on the PROPHECY® or Z2™ brand paintball loaders. The body, although somewhat different in ornamental appearance, has the same general configuration, namely, each of the first portion 902 and second portion 903 include a front portion 866, top wall 908, an opening or mouth area for receiving paintballs 909, a rear or back area 910, a lower wall rear 911, and a lower front wall 914.

The components of the paintball loader shown in FIGS. 8-10 include a feed mechanism assembly 920, comprising one or more of the following: a battery holder 921, manual drive assist knob 922, motor 923 with battery harness and battery, drive shaft 925, drive carrier (feeder) 926, circuit board with microprocessor 927, floor 928, back bone, or frame 929 including an outfeed tube or feed neck 930. As shown in FIGS. 8-10, all of the components are housed on the frame 929 to form an integral feed mechanism assembly 920 which may be removed as a unit. Additional components that may comprise parts of the feed mechanism assembly 920 are shown and identified in FIG. 10.

As shown in FIG. 9, when the first portion 902 or the second portion 903 are moved via the hinge to open the body and gain access to the contents, the entire feed mechanism assembly 920 can be accessed or removed.

As shown in FIGS. 8 and 9, the paintball loader is still capable of remaining attached to a paintball marker while the body is opened. This, unlike known paintball loaders, a user is able to access essentially the entirety of the internal components of the paintball loader with the body removed, and the paintball loader feed mechanism still operatively attached to a paintball marker.

The edge of each body portion could be formed with a flange or a tongue-and-groove arrangement, to assist in aligning or providing some overlap the body portions when they are attached together. A peripheral flange or lip could be provided as a thinner portion of one of the body portions along its outer edge, and could be overlapped by the other of the body portions when the two are brought together.

The body portions are preferable essentially the same size and may be formed as mirror images of each other. They may also be different sizes depending on where the vertical split is formed.

The body portions may include a part shaped as and/or covering the outfeed tube or feed neck of the paintball loader. The body portions may also not include a part shaped as and/or covering the outfeed tube or feed neck of the paintball loader.

Figure 12:
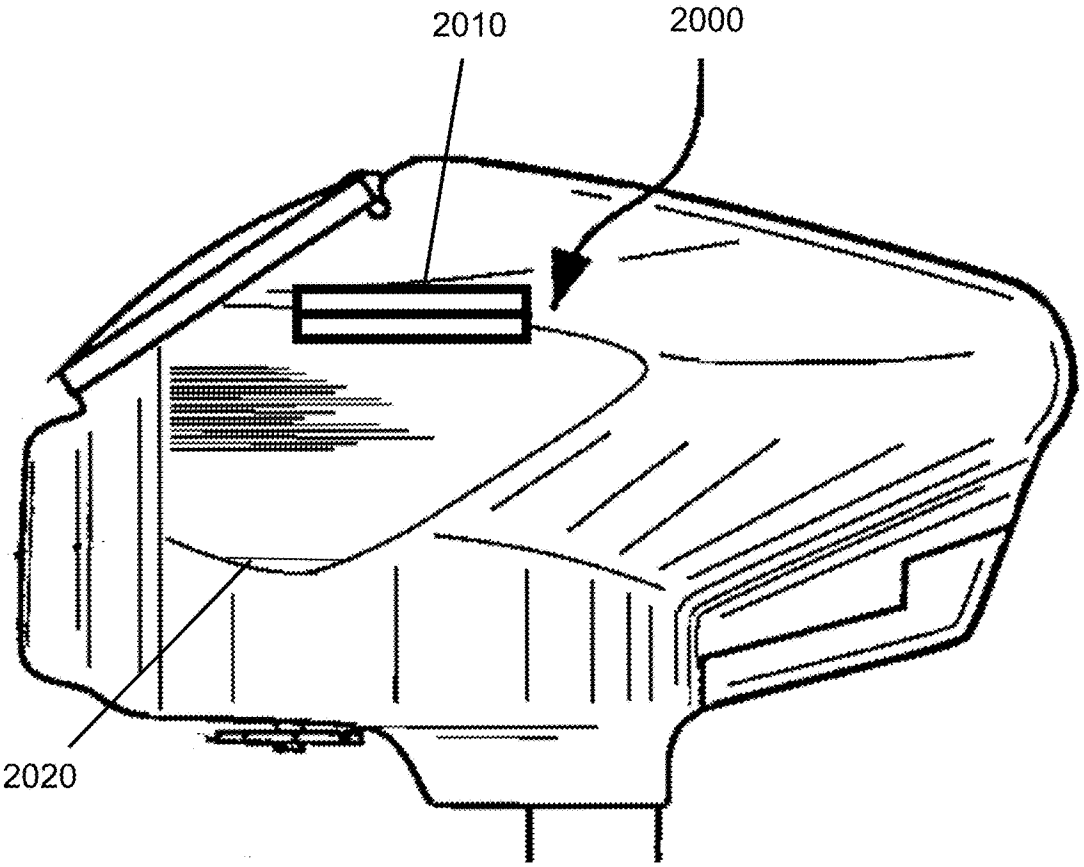
FIG. 12 shows an example attachment and release mechanism for the body portions of a paintball loader according to an embodiment of the invention.

It is appreciated that only a portion of the paintball loader body may be hinged so that it can be flipped up to access the inside of the paintball loader. Thus, a portion of a wall of the body 901 is provided as a flip-up hinged window 2000, as shown in FIG. 12. The window 2000 can be joined to the body by a hinge 2010 at one end, preferably an upper end, and an attachment mechanism 2020 at the lower end. The attachment mechanism can be, for example, a mechanical snap fit. A tab or indentation may be provided to allow a user to open the window. Again, the window 2000 provides for side access, and can be of various sizes or proportions as compares to the overall paintball loader body.

Some known paintball loaders may open from the top, with a horizontal split provided between an upper portion of the body of those paintball loaders and a lower portion of the body. This only provided top-down access to the interior components. In addition, the tops and bottoms of the bodies of known paintball loaders must be completely separated to access the interior. Other paintball loaders have bodies that come apart into multiple pieces, where the pieces are not joined, and therefore additional assembly and disassembly is required. Moreover, multiple pieces can get lost.

The arrangement of the present invention, having a hinge along the spine of the upper top wall of the paintball loader body, allowing for a vertical or longitudinal split, with both sides of the body attached by a hinge, provides advantages over the prior art. The internal components can be readily and fully accessed. One side portion can be flipped up to access the interior components. The hinge allows the side portions to stay attached when the body is opened. Side access provides a greater area for servicing or otherwise accessing the interior of the paintball loader.

It is understood that this invention is not limited to the particular embodiments disclosed, but is intended to cover all modifications and combinations which are within the spirit and scope of the invention as described herein and/or defined by the appended claims, the above description, and/or shown in the attached drawings.

What is claimed is:

1. A side opening paintball loader, comprising:

a body defining an interior area housing internal components;

a feed mechanism comprising a moveable feeder and a motor housed within the interior of the paintball loader body;

the body being split generally vertically along at least a part of the length of the body into a first portion and a second portion;

the first portion attached to the second portion by a hinge positioned along a vertical axis of the body, the first portion and second portion moveable relative to each other via the hinge between an open position and a closed position;

wherein movement of the first portion relative to the second portion exposes at least portions of at least some of the internal components of the paintball loader, and wherein the feed mechanism is configured to be at least partially removable from the paintball loader body when body is in the open opposition.

2. The paintball loader of claim 1, wherein the first portion and the second portion are essentially the same size.

3. The paintball loader of claim 1, further comprising a moveable feeder housed within the interior of the paintball loader body.

4. The paintball loader of claim 1, wherein the feed mechanism is configured to be completely removable from the paintball loader body when body is in the open opposition.

5. A side opening paintball loader, comprising:

a body defining an interior area housing internal components;

the body being split generally vertically along at least a part of the length of the body into a first portion and a second portion;

the first portion attached to the second portion by a hinge positioned along a vertical axis of the body, the first portion and second portion moveable relative to each other via the hinge between an open position and a closed position;

a release mechanism configured to selectively permit detaching the first portion and the second portion;

wherein movement of the first portion relative to the second portion exposes at least portions of at least some of the internal components of the paintball loader;

wherein the first portion and the second portion are removably engaged.

6. A side opening paintball loader, comprising:

a body defining an interior area housing internal components;

at least a part of the body being split generally vertically along the length of the body into a first portion and a second portion;

the first portion attached to the second portion by a hinge positioned along a vertical axis of the body, the first portion and second portion moveable relative to each other via the hinge between an open position and a closed position;

wherein movement of the first portion relative to the second portion exposes at least portions of at least some of the internal components of the paintball loader;

wherein the hinge is spring-biased to an open position or to a closed position.

* * * * *